US005829949A

United States Patent [19]

Brown

[11] Patent Number: 5,829,949

[45] Date of Patent: Nov. 3, 1998

[54] DISPENSING BUCKET APPARATUS AND DISPENSING METHOD

[75] Inventor: Rodney E. Brown, Santa Fe, Tex.

[73] Assignee: Akard & Griffin, Houston, Tex.

[21] Appl. No.: 833,402

[22] Filed: Apr. 4, 1997

Related U.S. Application Data

[60] Provisional application No. 60/019,967 Jun. 17, 1996 and provisional application No. 60/015,486 Apr. 15, 1996.

[51] Int. Cl.[6] ..... B63B 3/16

[52] U.S. Cl. ..... 414/725; 414/526; 141/10; 37/903

[58] Field of Search ..... 414/526, 725, 414/912; 37/141, 903; 141/10; 222/412, 413, 608

[56] References Cited

U.S. PATENT DOCUMENTS

| | | | |
|---|---|---|---|
| 2,597,692 | 5/1952 | Wills et al. . | |
| 3,318,486 | 5/1967 | Felix . | |
| 3,552,346 | 1/1971 | Gorden | 414/526 |
| 3,598,266 | 8/1971 | Fisher . | |
| 4,055,255 | 10/1977 | Vasquez | 414/725 |
| 4,068,771 | 1/1978 | Zimmerman . | |
| 4,782,606 | 11/1988 | Surface . | |
| 4,798,510 | 1/1989 | Lazenby . | |
| 5,004,022 | 4/1991 | Carlsson | 141/10 |
| 5,564,886 | 10/1996 | Emerson et al. | 414/725 |

*Primary Examiner*—Brian L. Johnson
*Assistant Examiner*—Gregory A. Morse
*Attorney, Agent, or Firm*—Akard & Griffin

[57] ABSTRACT

A dispensing bucket apparatus that removably connects to a loader vehicle. The apparatus is a bucket that is adapted to receive and hold a flowable material and has an exit opening in its front end that is selectively opened and closed by a gate. The position of the gate may be controlled by the user from within the loader vehicle to control the flow and flow rate of the flowable material from the bucket. An alternate bucket design uses a manual latch to release the gate to an opened position. The side walls of the bucket converge toward the front of the bucket and form a funnel that directs the flowable material to the exit opening. The construction of the apparatus is such that the user can view the pour at all times and, thereby, reduce spillage and waste.

23 Claims, 6 Drawing Sheets

Fig. 3
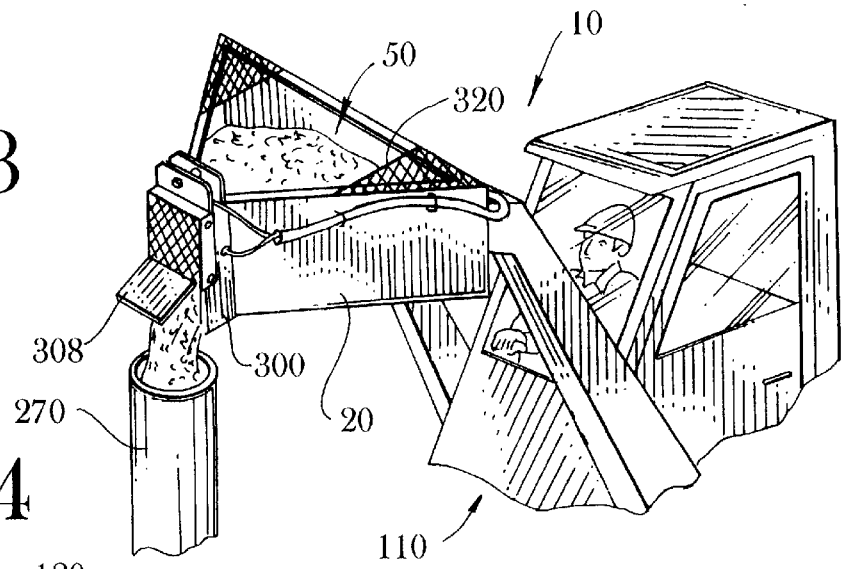
Fig. 4
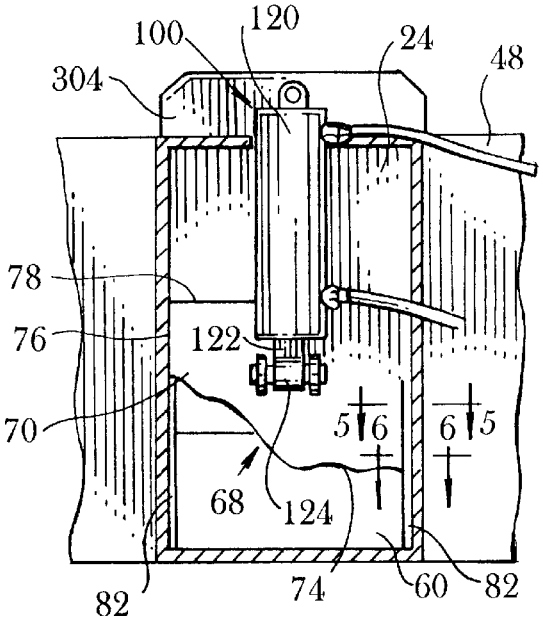
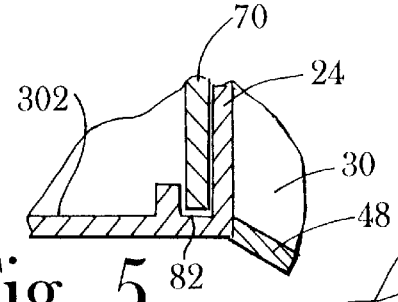
Fig. 5
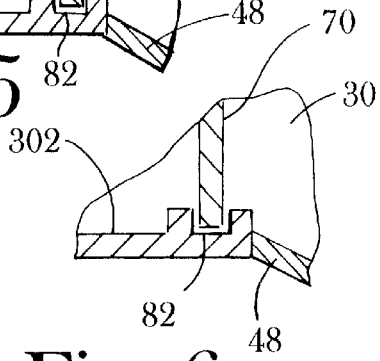
Fig. 6
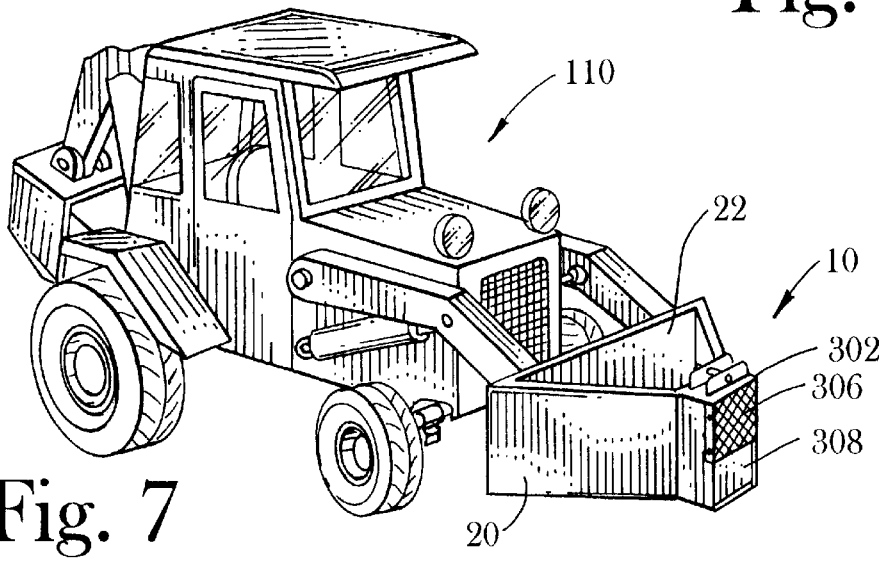
Fig. 7

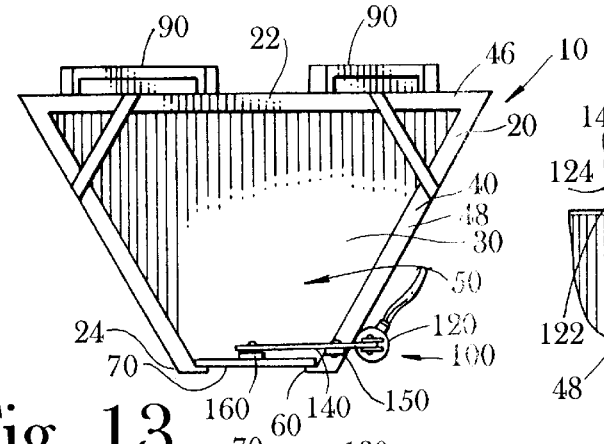
Fig. 13
Fig. 14
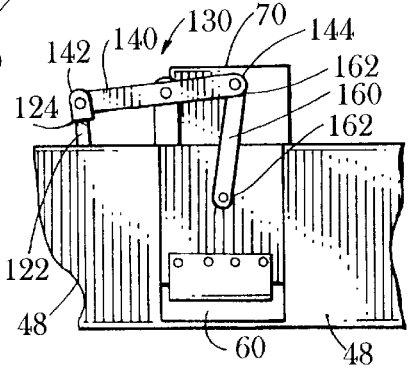
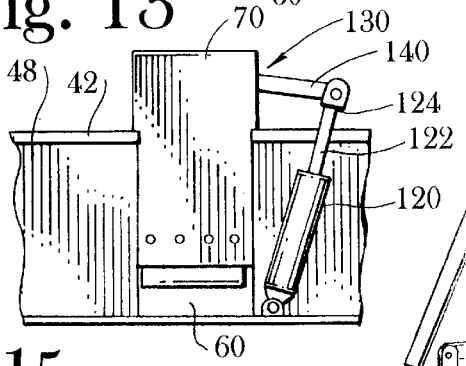
Fig. 15
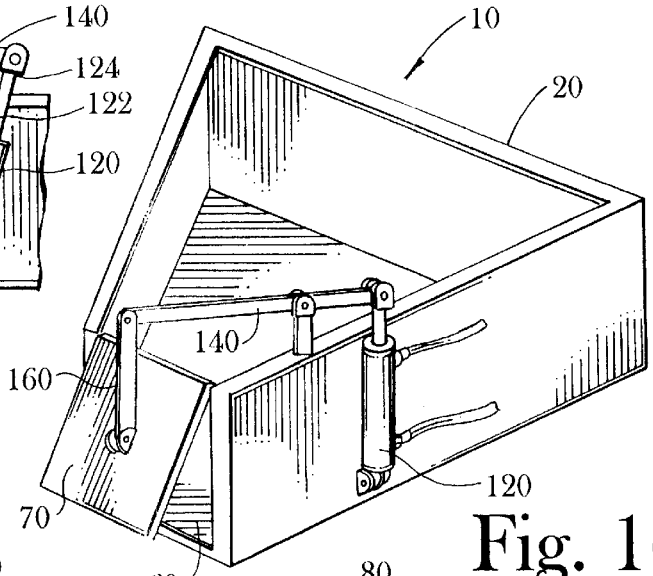
Fig. 16
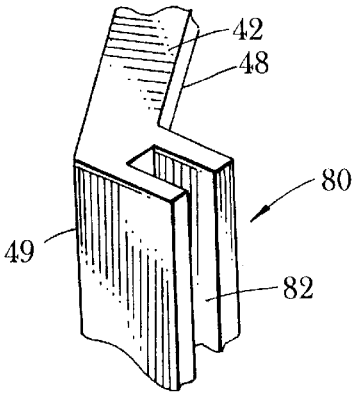
Fig. 18
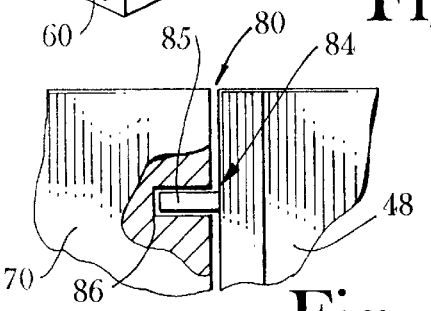
Fig. 19
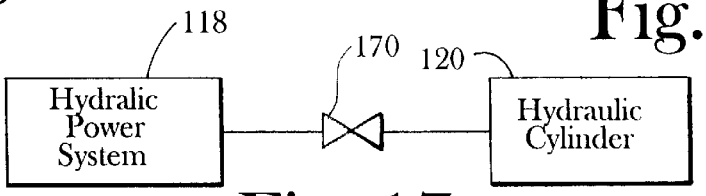
Fig. 17

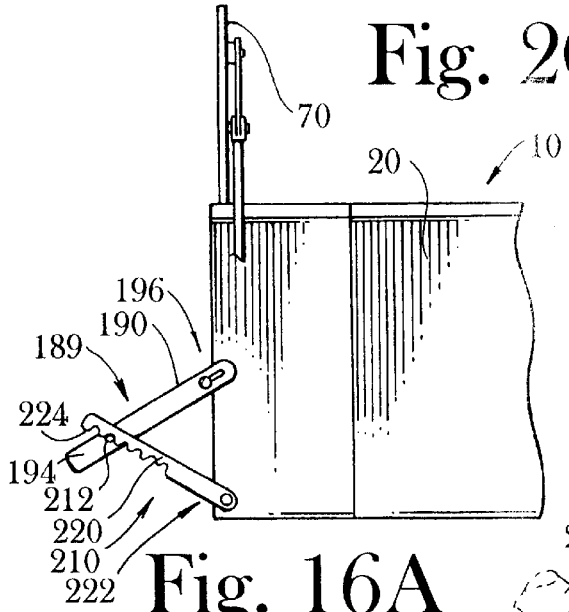
Fig. 20
Fig. 16A
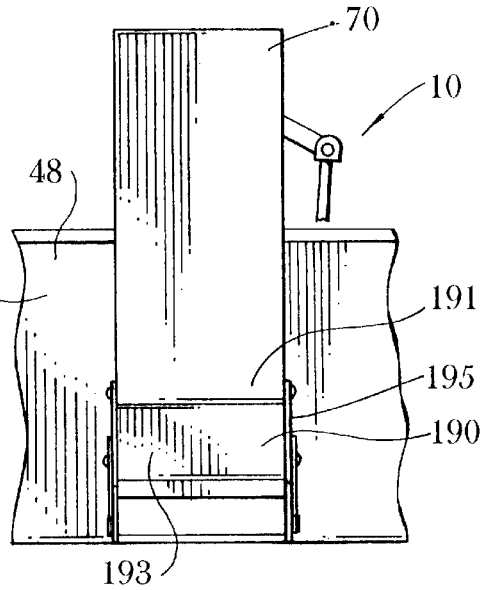
Fig. 21
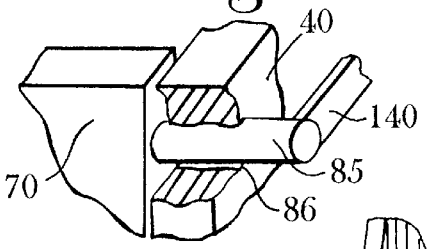
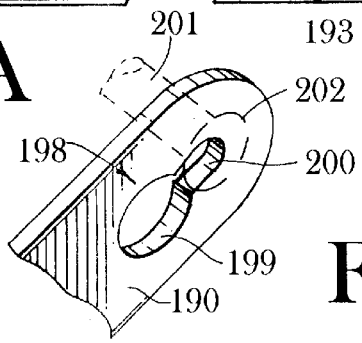
Fig. 20A
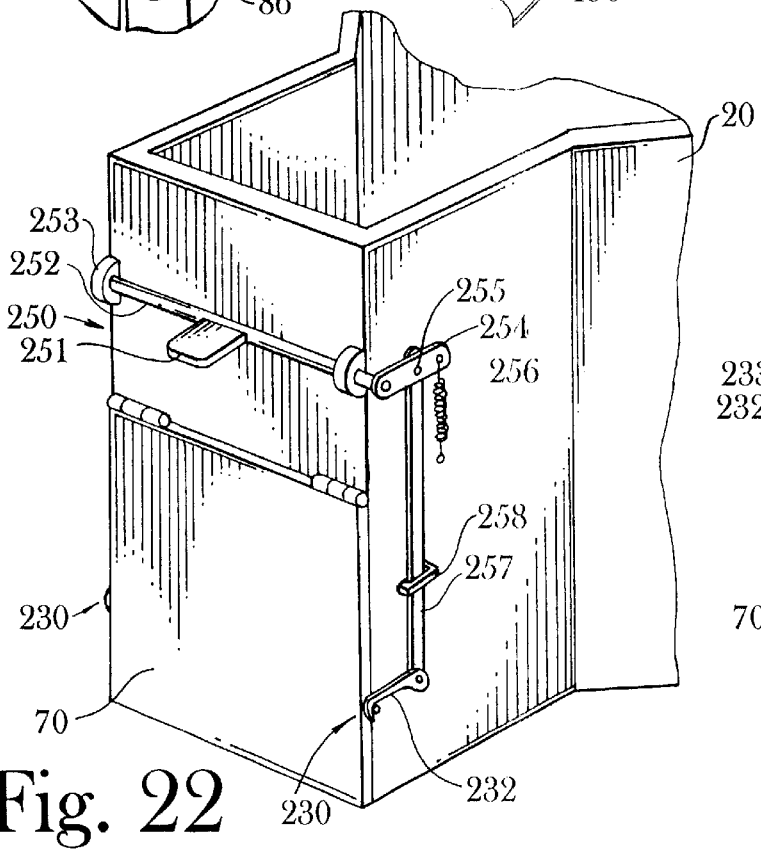
Fig. 22
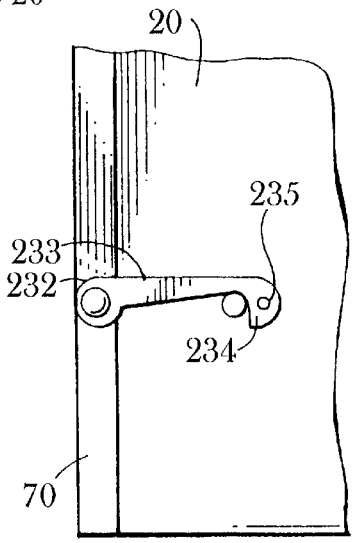
Fig. 23

DISPENSING BUCKET APPARATUS AND DISPENSING METHOD

BACKGROUND OF THE INVENTION

This application claims the benefit of U.S. Provisional Application 60/015,486, filed Apr. 15, 1996 and U.S. Provisional Application 60/019,967 filed Jun. 17, 1996.

1. Field of Invention

This invention relates to a loader vehicle attachment for dispensing a flowable liquid. More specifically, it is directed to a low cost dispensing bucket apparatus that attaches directly to the frame arms of a loader vehicle. Also, the invention is a method for dispensing a flowable material.

When spreading flowable materials such as concrete, the material must cover a specific broad area, the pour site. Typically however, the trucks carrying the material are unable to reach the pour site and are unable to properly distribute the material. In such a case, the distribution of the flowable material typically requires the use of wheelbarrows and substantial manpower. Due to physical limitations, each wheelbarrow can transport a limited amount of material. Accordingly, the labor costs and time required for completing a pour are substantial. Additionally, because materials such as concrete cure rapidly, failure to complete the pour rapidly may result in wasted material or a faulty pour. Thus, a relatively fast distribution of the material reduces the risk of material waste and a faulty pour.

As used herein, loader vehicles include "skid-steer" loaders, backhoes, forklifts, sky-lifts, track-hoes, tractor loaders and other vehicles that include a hydraulic system and that are capable of removably receiving an attachment thereon. For ease of description, the following discussion will primarily focus on skid-steer loaders. However, other types of loader vehicles are addressed from time to time.

Generally, skid-steer loaders are vehicles designed to operate in rough terrain and perform a variety of functions. The loader vehicles include loader frame arms that extend in front of the loader vehicle and that may be raised and lowered by hydraulic cylinders. The same hydraulic power system that operates the frame arms may also operate auxiliary equipment on the loader vehicle. The ends of the frame arms include releasable attachments that permit rapid connection of auxiliary equipment to the loader vehicle. Also, the attachment enables tilting of the auxiliary equipment.

Consequently, the skid-steer loaders have evolved into multi-function vehicles as more and more attachments for the loader vehicles have been designed. Examples of attachments include dumping buckets, stump grinders, sweepers, trenchers, backhoes, angle blades, pallet forks, among many others.

Also included among the skid-steer loader attachments is a standard dumping bucket. The loader vehicle may tilt the dumping bucket downward to scoop material therein and to dump material therefrom and may tilt the bucket upward to hold the material. Because the bucket walls are sealably connected, the bucket can carry a flowable material. However, the walls of the bucket are typically slanted to facilitate scooping. Thus, spillage of a flowable material is common. Also, when pouring from the bucket, the flowable material tends to splash resulting in additional wasted material. Perhaps the most important shortfall of the bucket in pouring a flowable material, results from elongated design of the bucket. Generally, the buckets extend the full width of the loader vehicle to promote more efficient scooping of material and increased capacity. Completing a pour, however, frequently requires precision in directing the flowable material to the pour site. Often the desired pour location is a small or narrow area such as a post hole. Accordingly, the standard dumping bucket cannot complete a large number of the jobs involving a flowable material.

Like the skid steer loaders, the other loader vehicles typically include loader frame arms that extend in front of the loader vehicle and that may be raised and lowered by hydraulic cylinders. They include a hydraulic power system that may operate auxiliary equipment on the loader vehicle. In addition, they typically have releasable attachments that permit rapid connection of auxiliary equipment to the loader vehicle. Also, the attachment enables tilting of the auxiliary equipment.

Many forklifts are now designed for rough terrain and many include tilting mechanisms. Further, a number of forklifts have been adapted to receive auxiliary equipment that may be actuated using the hydraulic system of the forklift.

2. Related Art

Prior efforts have attempted to alleviate the burden of distributing a flowable material and the associated waste. Illustrative of such attempts are U.S. Pat. No. 3,598,266 that issued to Fisher on Aug. 10, 1971 and U.S. Pat. No. 4,068,771 that issued to Zimmerman on Jan. 17, 1978.

The Fisher reference shows a bucket attachment to a wheeled loader bucket for controlling the flow rate and the direction from a standard bucket. The gate attachment is pivotally connected to the bucket and is also connected at its top by a cable that extends over the top of the bucket. The flow rate is controlled by varying the tilt angle of the bucket which in turn varies the length of the support cable. This changes the opening between the gate and the bucket. The funneling device bolts onto the bucket and includes angled walls that direct the flow toward a centrally located opening through which the material is dispensed. The attachments require permanent destructive modification of the bucket. The gate attachment control is dependent on the bucket control and is, thus, relatively imprecise.

The Zimmerman reference is directed to an attachment apparatus for connecting a carrier bucket to a wheeled loader bucket. The carrier bucket includes inclined walls that direct the material to a narrow opening. The carrier bucket is attachable to the loader bucket using side linkages that do not require destruction of the loader bucket and that are remote from the material and, therefore, are more easily removed. One apparent problem with the linkage connection is that it will not likely work with a standard skid steer loader because the clearance between the bucket and the machine is too small, when the bucket is in a lowered position, to allow the connecting linkages to pass therebetween. Also, the carrier bucket includes a manually operated lift gate that facilitates restriction of the flow through the opening. Although the reference does not describe the operation of the metering gate, it is apparent that the manual gate may be operated in only one of two ways. In one possible manner of operation, the metering gate must be opened to a predetermined position and maintained in that position during operation of the loader vehicle and the bucket. In the other possible manner of operation, the loader vehicle must stop completely before the metering gate is adjusted and the operator as well as the person operating the metering gate must adhere to a strict set of predetermined safety procedures. In fact, such a procedure would most likely require a third person and a set of hand signals for safe operation of the bucket attachment. Otherwise, operation of the metering gate would present a substantial risk of injury to the person operating the metering gate. Because the loader bucket obstructs the loader vehicle operator's view of the front of the container bucket where the gate is located, because of the substantial mass of the loader vehicle and its load, and because of the inexact control of the loader vehicle, the likelihood of injury to a person operating the gate is high.

However, the greatest deficiency with the above cited references relates to the fact that they are attachments to buckets of a wheeled loader vehicle. The size of the loader vehicle buckets is relatively large and prevents the operator from seeing the gate and the exit of the flowable material. In addition, the loader bucket prevents the user from adequately aligning the material exit with the desired pour site. The operator of the loader vehicle sitting in the loader vehicle cab cannot view the pour of material or judge the flow rate of the material. Accordingly, the operator cannot adequately oversee the pour to prevent waste of material resulting from misalignment, improper flow rate, and insufficient gate control among other deficiencies.

Though the above mentioned attachments to wheeled loader buckets may be helpful in directing the flow of material to a narrow opening, a better alternative is to provide a specially designed bucket that attaches to a loader vehicle, that includes a gate at its narrow opening which may be controlled remotely from the cab of the loader vehicle, and that allows the loader vehicle operator to view the pour during operation.

SUMMARY OF THE INVENTION

Accordingly, the objectives of this invention are to provide, inter alia, a dispensing bucket apparatus and dispensing method that:

- attaches to a loader vehicle frame arm directly, not merely to a loader bucket;
- may be lifted and tilted by the loader vehicle;
- can receive and maintain a flowable material therein;
- reduces spillage of the flowable material during transport;
- narrows toward its front end to provide a funnel that directs the flowable material to a relatively narrow opening;
- may include a gate for the narrow opening that may be controlled from within the loader vehicle cab;
- may include a gate for the narrow opening that may be opened from a remote location;
- may include a quick release latch on the gate that enables safe manual operation and uses the pressure of the cement against the gate to provide the force to open the gate;
- dispenses flowable liquid from the apparatus without requiring tilting of the bucket;
- utilizes the hydraulic power system of the loader vehicle to actuate and control the apparatus;
- permits the loader vehicle operator to view the pour while filling the bucket and while making the pour of flowable material;
- includes a diverter shield that directs the flow from the opening downward to enhance alignment of the pour;
- facilitates precise control of the flow rate, placement, and amount of flowable material dispensed;
- provides for safe operation; and
- is low in cost and easy to implement.

Other objects of the invention will become apparent from time to time throughout the specification and claims as hereinafter related.

To achieve such improvements, my invention relates to a dispensing bucket apparatus that has a bucket having an upper portion adapted to receive a flowable material therein and an exit opening that is sufficiently large to permit the flowable material to exit therethrough. A gate means provides for the selective opening and closing of the container and adjustment of the opening size. The bucket is adapted for attachment to a loader. When attached, a gate control means facilitates actuation and adjustment of the position of the gate means by a user from within the loader vehicle.

The present invention also relates to a dispensing bucket apparatus that has a bucket and gate means as described above. The bucket has a peripheral wall and a substantially flat bottom; the exit opening extends to the bottom of the bucket; and the gate means opens from the bottom. In this way, the bucket is emptied proximal the bottom of the bucket. Also, the wall is sufficiently short so that the user can see into the bucket when the bucket if in the lowered position. Due to the flat bottom, the user can see the flowable material exiting the bucket through the exit opening.

The present invention also relates to a dispensing bucket apparatus that has a bucket and gate means as described above. The bucket has a back wall and two side walls that form a peripheral wall. The side walls converge linearly toward one another from opposing ends of the back wall to the exit opening. Thus, for a given bucket length, the side walls form the greatest possible angle with the back wall.

The present invention also relates to a dispensing bucket apparatus that has a bucket and gate means as described above. The gate means is a gate that extends the full length and height of the exit opening and slides in vertical slots disposed in the side walls.

The present invention also relates to a method of delivering a flowable material that includes attaching a bucket to a loader vehicle, placing the flowable material in the bucket, driving the loader vehicle to the delivery site, and controlling the gate means of the bucket from within the loader vehicle to control the dispensing of the flowable material.

The present invention also relates to a method for forming structures that comprises forming a mold having a pour opening for the concrete structure, attaching to a loader vehicle a bucket having an upper open portion adapted to receive the concrete therein, an exit opening that is sufficiently large to permit the concrete to exit therethrough, and an adjustable gate means for selectively opening and sealingly closing the exit opening and controlling the size of the exit opening when the exit opening is open, placing the concrete in the bucket, driving the loader vehicle to the desired delivery site and positioning the exit opening over the pour opening of the mold, controlling the gate means from within the loader vehicle to control the flow and flow rate of the flowable material from the bucket into the mold, and removing the mold from around the concrete structure after the concrete has set.

The present invention also relates to a method for controlling the flow of a flowable material from a bucket that has an upper open portion adapted to receive a flowable material therein and an exit opening that is sufficiently large to permit the flowable material to exit therethrough and that is attached to a loader vehicle that comprises selectively opening and sealingly closing the exit opening and controlling the size of the exit opening when the exit opening is open using a gate, actuating the gate and controlling the position of the gate—and, thus, the size of the exit opening—from within a loader vehicle when the bucket is functionally attached to the loader vehicle using a hydraulic cylinder attached to the gate and actuated by a hydraulic power system of the loader vehicle.

BRIEF DESCRIPTION OF THE DRAWINGS

The manner in which these objectives and other desirable characteristics can be obtained is explained in the following description and attached drawings in which:

FIG. 3 is an isometric view of the dispensing bucket apparatus attached to a skid steer type loader vehicle making a pour into a tubular mold.

FIG. 4 is a partial, cross sectional, elevation view of the front dispensing bucket apparatus.

FIG. 5 is a partial, cross sectional view of the slot and the gate.

FIG. 6 is a partial, cross sectional view of the slot and the gate.

FIG. 7 is an isometric view of the dispensing bucket apparatus attached to a backhoe.

FIG. 13 is a top elevational view of the first alternate embodiment for the dispensing bucket apparatus shown in FIGS. 9 and 10.

FIG. 14 is a partial, elevational view of the dispensing bucket apparatus from the inside of the bucket.

FIG. 15 is a front elevational view of the dispensing bucket apparatus.

FIG. 16 is an isometric view of the dispensing bucket apparatus showing a hinged gate.

FIG. 16A is a partial cross sectional, isometric view showing an alternate linkage system for a hinged gate design.

FIG. 17 is a schematic of the hydraulic system and controls of the dispensing bucket apparatus.

FIG. 18 is a partial, isometric view of the slot.

FIG. 19 is a partial, cross sectional, elevational view of the hinged gate.

FIG. 20 is a side elevational view of the dispensing bucket apparatus showing the diverter.

FIG. 20A is a partial isometric view of the diverter side showing the connection slot.

FIG. 21 is a partial, front elevational view of the dispensing bucket apparatus showing the diverter.

FIG. 22 is a partial, isometric view of the dispensing bucket apparatus having a manual release door.

FIG. 23 is a partial, side elevational view of a simple latch.

DETAILED DESCRIPTION OF THE INVENTION

Figure 1:
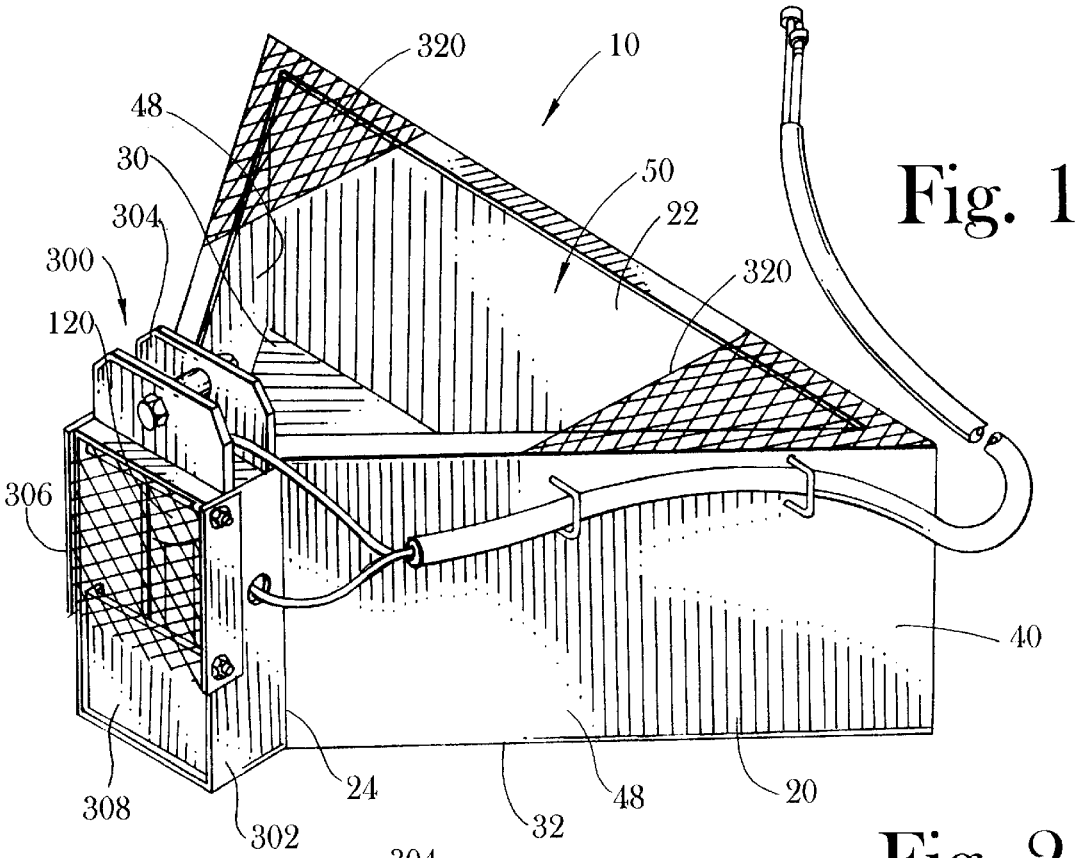
FIG. 1 is an isometric view of the dispensing bucket apparatus.

The preferred embodiment of my invention is illustrated in FIGS. 1 through 24 and the dispensing bucket apparatus is depicted as 10. Generally, the dispensing bucket apparatus 10 is a bucket adapted to receive a flowable material therein. It has an exit opening 60 that may be selectively opened and closed by a gate means 68 and the bucket 20 is adapted for attachment to a loader vehicle 110. A more detailed description of the apparatus 10 and the figures follows.

As stated previously, loader vehicles, as used herein, include "skid-steer" loaders, backhoes, forklifts, sky-lifts, track-hoes, tractor loaders and other vehicles that include a hydraulic system and that are capable of removably receiving an attachment thereon.

The dispensing bucket apparatus 10 is removably attachable to a loader vehicle 110. An operator of the loader vehicle 110 sits within a loader vehicle cab 112. The loader vehicle 110 of the skid steer or other typical loader types—as opposed to a forklift—includes lifting arms (referred to herein as the "loader frame" 114) that extend in front of the loader vehicle 110 and that may rotate to a variety of raised and lowered positions. A hydraulic power system 118 of the loader vehicle 110 provides the power for raising and lowering the loader frame 114 and for tilting any auxiliary equipment attached to the loader frame 114. A loader frame control means 117 provides for control of lifting the loader frame and tilting of any attached auxiliary equipment. The extreme forward end of the loader frame 114, the frame apogee end 116, includes releasable attachments that securely fasten auxiliary equipment to the loader vehicle 110. Using skid steer loaders as an example, for proper fastening, the auxiliary equipment need only include the proper lips and connecting holes to attach to the standard loader vehicle connectors. These loader vehicle connectors allow for relatively fast connection and disconnection of the auxiliary equipment. From within the loader vehicle cab 112 (also referred to herein as simply "within the loader vehicle 110"), the operator may control the movement of the loader vehicle 110 as well as the hydraulic power system 118 and loader frame 114 using the loader frame control means 117.

An attachment means 90 provides selective, removable attachment of the bucket 20 to the loader vehicle 110. As described previously, the loader vehicle 110 includes connectors proximal the frame apogee end 119 of the loader frame 114. Accordingly, the attachment means 90 may merely comprise the loader vehicle connectors and matching connectors secured to the bucket 20. The attachment means 90 and connectors permit the bucket 20 to tilt relative to the loader frame 114. These connectors are known to those skilled in the art.

Likewise, forklifts and the like have been adapted so that auxiliary attachments may be connected to them and they are constructed to permit tilting of the lifting blades and, thus, any attached equipment. A operator sitting within and controlling the forklift can adjust the height of the attached equipment as well as the relative tilt of the attached equipment.

"Flowable material" includes any material that is capable of flowing or moving through the relatively narrow exit opening. Examples of flowable materials include, inter alia, concrete, mud, sand, dirt, rocks, grain, feed, nuts, bolts, nails, and the like.

The bucket 20 has an upper open portion 50 adapted to receive a flowable material therein and an exit opening 60 that is sufficiently large to permit the flowable material to exit therethrough. The bucket 20 has a bottom 30, a front 24, and a back 22. Extending upwardly from a perimeter 32 of the bottom 30, preferably at a right angle, is a peripheral wall 40. The wall 40 and the bottom 30 are sealably connected at the wall bottom end 44 and define an upper open portion 50 in the bucket 20. In addition, the bottom 30 and the wall 40 define an exit opening 60 in the bucket 20. To permit the flowable material to rapidly exit through the exit opening 60, the exit opening 60 is relatively large. A gate 70 connected to the bucket 20 seals the exit opening 60 when closed so that the bucket 20 can receive and maintain a flowable material the bucket 20.

In the preferred embodiment the bucket 20 has a back 22 and two side walls 48 that form the peripheral wall 40. Although the forks of a forklift may be used to support and hold the bucket 20, typically the back 22 of the bucket 20 is adapted to be removably affixed to a loader vehicle 110 so that the rearward end of the bucket 20 attaches to the loader vehicle 110. Opposite the back 22 is the front 24: The side walls 48, sealingly connected to opposite ends of the back 22, linearly converge toward one another from the back 22 toward the front 24 and the exit opening 60. In this way, the bucket 20 narrows from the back 24 to the front 22. At the front 24, the side walls 48 preferably do not meet or touch. To the contrary, the bottom 30 and the side walls 24 define the exit opening 60 at the front 24. Thus, the gate 70 is at the front 24. With this design, the back 22, the side walls 48, and the gate 70 form a trapezoidal shaped bucket 20. With a trapezoidal shape, the side walls 48 act as a type of funnel that directs the flowable material to the exit opening 60. Because the side walls 48 are substantially straight (i.e. planar), the bucket 20 does not include any obstructions that restrict the flow of the flowable material to the exit opening 60. Using this preferred construction, the side walls 48 extend from the back 22 at the greatest possible angle for a bucket 20 having a fixed length from the back 22 to the exit opening 60 and, therefore, utilizes the pressure exerted by the flowable material against the side walls 48 to force the flowable material through the exit opening 60 in the most efficient manner possible. An added advantage to the trapezoidal shape of the bucket 20 is that the shape causes the center of mass and the moment of inertia to be closer to the loader vehicle 110 than a bucket that does not have angled sides throughout its full length. Consequently, the weight is closer to the loader vehicle 110 for a bucket 20 having a given length and allows the bucket 20 to be longer. This places the exit opening 60 further from the loader vehicle 110 and allows the bucket 20 to pour further from the loader vehicle 110. Stated another way, the increased length increases the reach of the bucket 20. Also, moving the weight closer to the bucket 20 reduces the risk of tipping of the loader vehicle 110 when the bucket 20 is full and, thereby, facilitates use of a higher capacity for the bucket 20.

So that the exit opening 60 is centrally positioned in the front of the bucket 20, the angles formed between the back wall 22 and each of the side walls 48 are equal. Preferably, the exit opening 60 extends to the bottom 30 of the bucket 20 so that the bucket 20 may be emptied proximal its bottom 30.

Also, the preferred embodiment includes a pair of triangular steps 320 proximal the back 22 of the bucket 20 at the top end 42 of the peripheral wall 40 that the user may use when entering and exiting a loader vehicle 110 that has its door in the front. These steps 320 provide additional support for the bucket 20 and increase its rigidity and strength.

The exit opening 60 may be selectively opened and closed using a gate means 68. Preferably, the gate means 68 is actuated by a gate control means 100 that the operator controls from within the loader vehicle 110. However, the gate means 68 may also be opened and closed manually as shown in FIGS. 22 through 27. The following discussion first addresses the gate means 68 that the operator controls from within the loader vehicle 110, or another remote location and then discusses the manually controlled gate means 68.

In the remotely controlled type of apparatus 10, the gate means 68 provides for selective opening and sealed closing of the exit opening 60 and provides for control of the size of the exit opening 60 when the exit opening 60 is open. The gate 70 has a top end 72, a gate bottom 74, and two opposing gate sides 76. In the preferred embodiment (FIGS. 1 through 15, 18, and 20 through 21), the bucket 20 has a pair of vertically extending slots 82 on each side of the exit opening 60 (at the front end of the side walls 48). Each vertically extending slot 82 has sufficient width to slidably receive one of the gate sides 76 therein. Therefore, the vertically extending slots 82 hold both sides 76 of the gate 70 and support the gate 70 therebetween. The gate 70 extends between and is slidably positioned within the slots 82. Thus, the gate 70 slides vertically in the slots 82 to selectively open and close the exit opening 60 and to control the size of the exit opening 60 when it is open. With this configuration, the gate means 68 opens from the bottom and, thereby, empties the bucket 20 proximal the bottom 30 of the bucket 20. The gate 70 may slide completely to the bottom of the exit opening 60 and into contact with the bottom 30 of the bucket 20 and seal, or close, the exit opening 60. As the gate 70 may slide from the closed position to any other position up to its upper limit, the gate 70 may vary the size of the exit opening 60 and regulate the flow rate through the exit opening 60.

As shown in FIGS. 4 and 5, the bucket 20 may include an actual front 24 against which the gate 70 slides. The sliding abutment of the gate 70 and the front 24 prevents flowable material from flowing therebetween. In this design, the front 24 provides an upper limit to the exit opening 60. Also, as shown in FIG. 5, the front 24 forms a back limit for the slot 82. A separate protrusion forms the forward limit for the slot 82. In addition, a protrusion extends below the front 24, as shown in FIG. 6, to define the back limit for the slot all the way to the bottom 30 of the bucket 20. The alternate embodiment for the slot 82, shown in FIG. 20, has the slot 82 and the exit opening 60 extending the full height of the bucket 20. Thus in this alternate embodiment, the gate 70 extends the full height of the bucket 20.

In an alternate embodiment shown in FIGS. 16, 16A, and 19, the gate connection means 80 provides a hinged attachment of the gate 70 to the bucket 20. A hinged connection 84 rotatably connects the top end 72 of each gate side 76 to the top end 42 of each adjacent side wall 48. In its simplest form, the hinged connection 84 may include a hinged connection post 85 extending from the gate side 76 into a hinged connection socket 86 in the adjacent side wall 48. The hinged connection post 85 and hinged connection socket 86 have a cylindrical shape. Because the hinged connection socket 86 has a diameter slightly greater than the diameter of the hinged connection post 85, the hinged connection post 85 may rotate in the hinged connection socket 86. Accordingly, the gate 70 may rotate about the hinged connection 84 to vary the size of the exit opening 60 and to selectively open and sealingly close the exit opening 60. Like the sliding attachment, with this hinged attachment of the gate 70 to the bucket 20 the gate means 68 opens from the bottom and, thereby, empties the flowable material from the bucket 20 proximal the bottom 30 of the bucket 20.

In the preferred embodiment, the gate control means 100 facilitates user control of the position of the gate 70 and, thus, the size of the exit opening 60 from within the loader vehicle cab 112 when the dispensing bucket apparatus 10 is functionally attached to the loader vehicle 110. It provides for actuating the gate means 68 and controlling the position of the gate means 68. Although the gate control means 100 may use an electric power supply or some other power supply, the gate control means 100 preferably utilizes the hydraulic power system 118 of the loader vehicle 110. In this preferred design, the gate control means 100 includes, generally, at least one hydraulic cylinder 120 having a movable ram 122 that is connected to the gate 70 such that movement of the ram 122 causes movement of the gate 70 and having a user controlled valve 170. The hydraulic cylinder 120 is mounted on the bucket 20. When the dispensing bucket apparatus 10 is functionally connected to the loader vehicle 110, the hydraulic cylinder 120 is in flow communication with and is controlled by the hydraulic power system 118 of the loader vehicle 110. A user within the loader vehicle 110 controlling the hydraulic power system 118 may, thus, control the hydraulic cylinder 120 and the ram 122 and the movement and position of the gate means 68.

Figure 2:
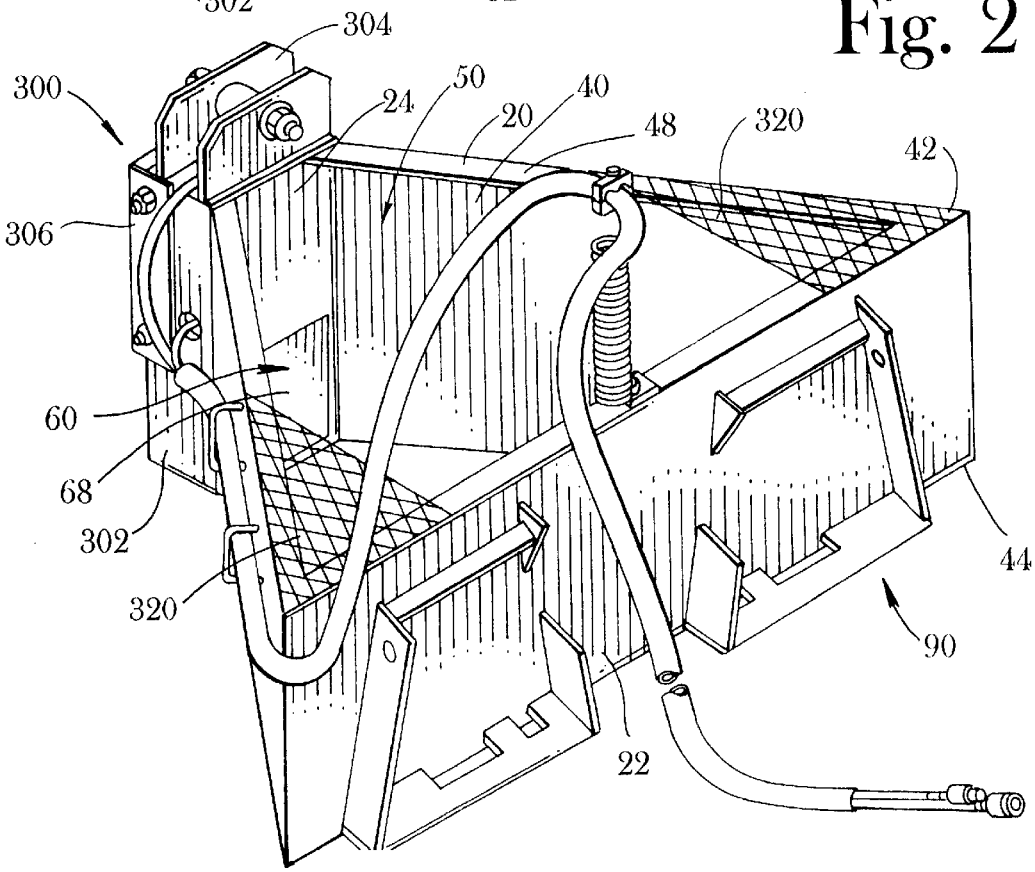
FIG. 2 is an isometric view of the dispensing bucket apparatus.
Figure 8:
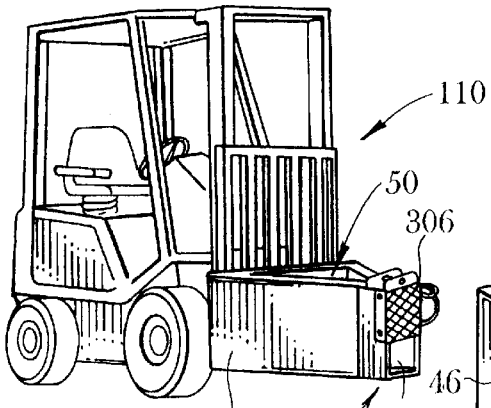
FIG. 8 is an isometric view of the dispensing bucket apparatus attached to a forklift.
Figure 9:
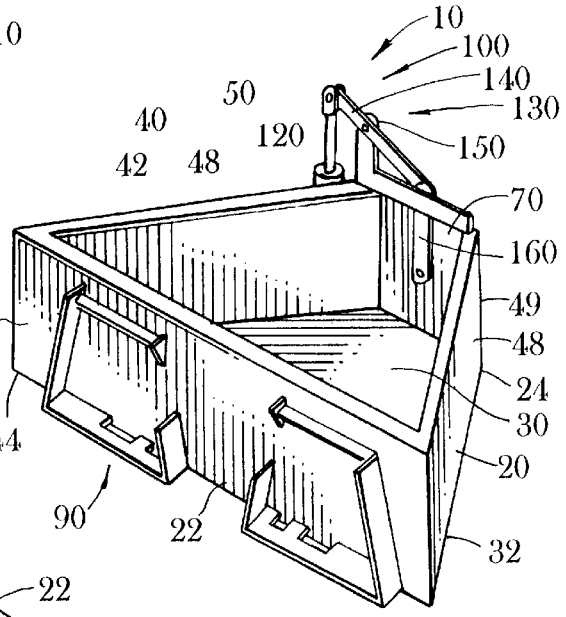
FIG. 9 is an isometric view of the dispensing bucket apparatus showing an alternate embodiment.
Figure 10:
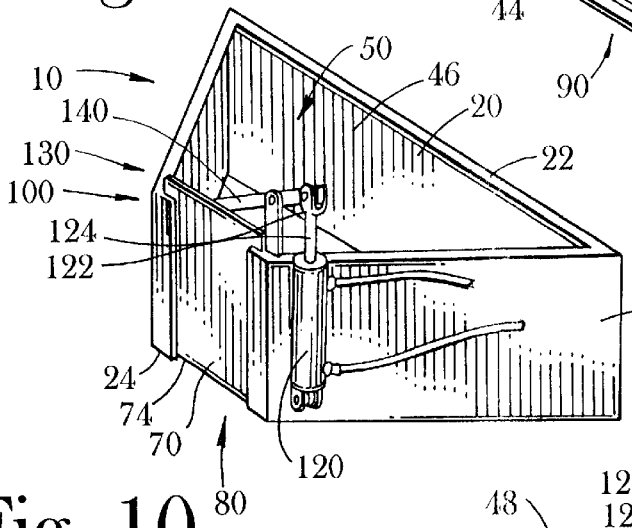
FIG. 10 is an isometric view of the dispensing bucket apparatus showing a different view of the alternate embodiment.
Figure 12:
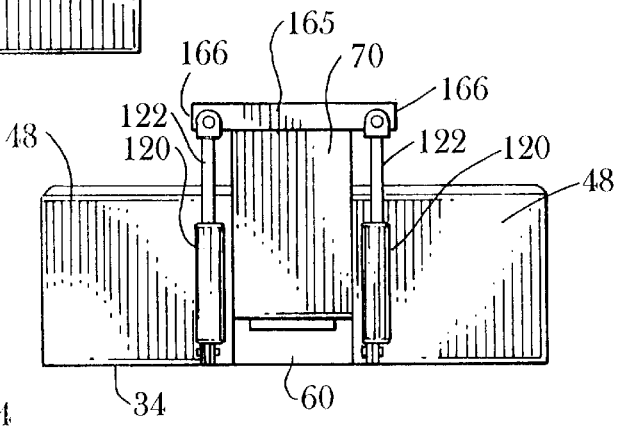
FIG. 12 is a front elevational view of a second alternate embodiment for the dispensing bucket apparatus.
Figure 11:
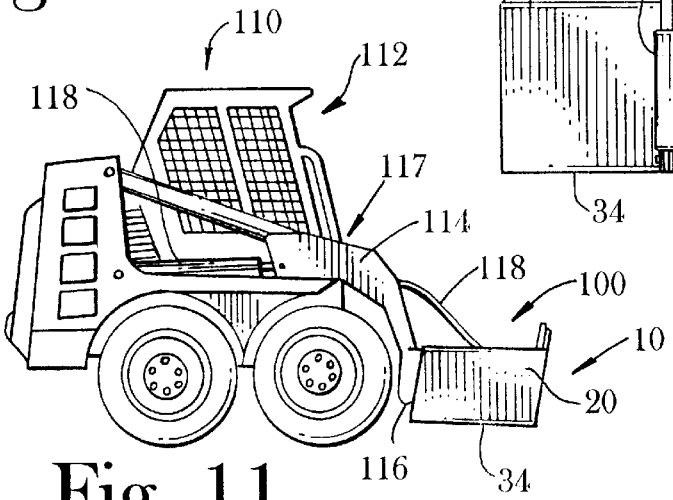
FIG. 11 is a side elevational view of the dispensing bucket apparatus attached to a skid steer loader.

The preferred embodiment is best shown in FIGS. 1, 2 and 4 and uses the sliding gate 70 construction. In this embodiment, the back of the hydraulic cylinder 120 is pivotally connected to the bucket 20 and extends in a vertically downward direction from the connection. The hydraulic cylinder 120 is positioned at the front 24 of the bucket 20 directly in front of the gate 70 and the exit opening 60, preferably at the lateral center of the gate 70 and the exit opening 60. The apogee end 124 of the ram 122 is connected to the gate 70—preferably near its center. Consequently, movement of the ram 122 produces a vertical sliding movement of the gate 70.

Using this preferred construction places the hydraulic cylinder 120 at a forward position where it is likely to be easily damaged. Accordingly, as shown in the figures, the bucket 20 includes a guard means 300 for encasing and protecting the hydraulic cylinder 120 while still permitting the flow of flowable material from the bucket 20. The guard means 300 shown has a guard chute 302 that extends from the front of the bucket 20 and has a front exit, a top, a bottom, and a pair of sides. The guard chute 302 has a height at least as great as the height of the bucket and a width at least as great as the width of the exit opening 60. Of course, the guard chute 302 is wide enough to accommodate the hydraulic cylinder therein. Thus, the guard chute 302 encircles the exit opening 60 and the gate 70. So that the flowable material may still exit the bucket 20, the guard chute 302 defines a cavity through which the flowable material may flow. The bottom 22 of the bucket 20 and the bottom of the guard chute 302 are level with one another to further facilitate ease of flow of flowable material from the bucket 20. The gate 70 is constructed so that when it is fully opened it does not contact the top of the guard chute 302. The hydraulic cylinder 120 is attached to a cylinder mounting bracket 304 attached to the top of the guard chute 302 and extends downward through a hole defined in the top of the guard chute 302. To ensure protection of the hydraulic cylinder 120, the length of the guard chute 302 is necessarily long enough to enclose the hydraulic cylinder 120 therein.

The front of the guard chute 302 is, preferably at least partially covered. As shown, a porous front cover 306 extends the fill width of the of the front exit of the guard chute and covers at least a portion of its height. To facilitate cleaning and maintenance, the front cover 306 is removably mounted and porous. As shown in the figures, the front cover 306 is a grid having a plurality of large voids. This porous construction facilitates ease of cleaning by allowing water to be sprayed therethrough to clean the hydraulic cylinder 120, gate 70, and other components within the guard chute 302. Covering the lower portion of the front exit is a flapper door 308 that extends the full width of the exit opening and has a height approximately equal to the height of the exit opening 60. The flapper door 308 and the front cover 306 provide additional safety because they prevent hands and other objects such as shovels from entering the guard chute 302. The top of the flapper door 308 is connected to the front exit of the guard chute 302 by a hinged connection intermediate the top and bottom of the guard chute 302. The flapper door 302 extends downward so that its bottom is proximal the bottom of the guard chute 302. However, to prevent sticking of the flapper door 308 there is preferably a small space between the bottom of the flapper door 308 and the bottom of the guard chute 302. The front cover 306 covers the portion of the front exit of the guard chute 302 not covered by the flapper door 308. Like the front cover 306, the flapper door 308 is removably attached to the guard chute 302. When the gate 70 is raised, the flowable material flows through the exit opening 60, through the cavity of the guard chute 302, forces the flapper door 308 open, and exits the bucket 20. In addition, the flapper door 308 is limited in its rearward rotation and travel. If pushed backward into the guard chute 302, the flapper door 308 is sufficiently long that it will impact the apogee end 124 of the ram 122 or the brackets connecting it to the gate 70. This limitation on the rearward movement of the flapper door 308 provides additional safety for the user by helping to keep foreign objects out of the guard chute 302 and, thereby, also protects the hydraulic cylinder 110.

An alternate design for the gate control means 100 is shown in FIGS. 9 through 10 and 13 through 15. This first alternate design uses a hydraulic cylinder 120 positioned at the side of the bucket 20 and a ram position translation means 130 that translates movement of the ram 122 into movement of the gate 70. As shown, to translate the motion of the ram 122 into a corresponding motion of the gate 70, the ram position translation means 130 uses linkages constructed of a substantially rigid material rotatably connected to one another, to the ram 122, and to the gate 70. A connecting linkage 140 having a first end 142 and a distal second end 144 pivotally attaches to the apogee end 124 at the first end 142 of the connecting linkage 140. A stationary linkage 150 fixedly attached to the bucket 20 provides a pivot point for the connecting linkage 140. Accordingly, the connecting linkage 140 is rotatably attached to the stationary linkage 150 intermediate the first end 142 and the second end 144 of the connecting linkage 140. Thus, as the ram 122 moves upward, the first end 142 of the connecting linkage 140 moves upward and the second end 144 moves downward. If the connection of the connecting linkage 140 to the stationary linkage 150 includes a slot that allows the connecting linkage 140 to slide relative to the stationary linkage 150, the second end 144 may pivotally attach to the gate 70 and provide the translational function.

However, in this first alternate embodiment the connection is not slotted and the ram position translation means 130 includes a gate linkage 160 having opposing ends 162. At one end 162, the gate linkage 160 rotatably connects to the connecting linkage 140. At the opposite end 162, the gate linkage 160 rotatably connects to the gate 70. Thus, as the ram 122 moves upward and the second end 144 of the connecting linkage 140 moves downward, the gate linkage 160 forces the gate 70 downward. Likewise, when the ram 122 moves downward, the linkages, 140 and 160, force the gate 70 open. In this way, the linkages, 140 and 160, translate the movement of the ram 122 into movement of the gate 70.

This first alternate design is shown in FIG. 16 as used in conjunction with a hinged gate 70. When using a hinged gate 70, however, the preferred method of actuating the gate 70 and of translating the motion of the ram 122 into motion of the gate 70 is shown in FIG. 16A. As shown in the figure, the hinge post 85 extends through the hinge socket 86 and through the peripheral wall 40. The connecting linkage 140 is fixedly attached to the end of the hinge post 85 opposite the gate 70. Consequently, movement of the ram 122 translates into rotational motion of the hinge post 85 and, thus, the gate 70.

A second alternate design for the gate control means 100 (see FIG. 12) uses two hydraulic cylinders 120. A hydraulic cylinder 120 is pivotally mounted proximal the front 24 of each of the side walls 48. The hydraulic cylinders 120 extend vertically, substantially parallel to one another. The hydraulic cylinders 120 are mounted such that the apogee ends 124 are above the remainder of the hydraulic cylinder 120. A connecting arm 165 attached to the top end 72 extends beyond the gate sides 76 at each of its connecting arm ends 166. The apogee end 124 of each of the hydraulic cylinders 120 pivotally connects to a separate connecting arm end 166. The pivotal connections prevent the hydraulic cylinders 120 from damaging the connecting arm 165 or the gate 70. To ensure that the rams 122 of the hydraulic cylinders 120 move in unison, hydraulic fluid passageways evenly direct the flow of hydraulic fluid from a single hydraulic fluid source to each of the hydraulic cylinders 120. As the rams 122 move upward, they force the gate 70 upward; and as the rams 122 move downward, they force the gate 70 downward.

To permit the operator to control the position and movement of the gate 70, the gate control means 100 includes a user controlled valve 170 in flow communication with both the hydraulic power system 118 and the hydraulic cylinder 120 (when the dispensing bucket apparatus 10 is functionally attached to the loader vehicle 110). The user controlled valve 170 regulates the flow of hydraulic fluid from the hydraulic power system 118 to the hydraulic cylinder 120. The user controlled valve 170 includes a standard control in the loader vehicle cab 112 that permits the operator to control the valve 170. Thus, the user controlled valve 170 is adapted and positioned for ready access and control by a user sitting within the loader vehicle 110. Such control may include a joystick or lever control, button control or a dial-type control among others.

The alternate embodiments previously discussed may include a diverter means 189 that is somewhat similar to the flapper door 308 of the preferred embodiment. The diverter means 189 (see FIGS. 20 and 21) permits adjustable control of the direction of flow from the dispensing bucket apparatus 10. When the dispensing bucket apparatus 10 is relatively full of flowable material, upon opening the gate 70 the pressure of the flowable material rapidly forces the flowable material through the exit opening 60. This rapid flow tends to project the flowable material a substantial distance beyond the front 24. Thereby, the rapid flow reduces the accuracy of pouring with the dispensing bucket apparatus 10, especially at elevated pour sites such as walls. In these cases, the pour is often made from above the loader vehicle cab 112 into a relatively narrow pour mold 270. In this elevated location, the projection of the rapid flow makes proper alignment virtually impossible.

Accordingly, the diverter means 189 provides a shield that deflects the projected material downward and prevents the flow from extending substantially beyond the front 24. In general, the diverter means 189 includes a diverter 190 having a diverter face plate 193, a hinged connection 196 for selectively and removably connecting the diverter 190 to the bucket 20, and preferably diverter set means 210 for adjusting the angle of the diverter 190 relative to the bucket 20.

The diverter has a top end 191, a diverter front 192, and a opposing diverter sides 195. The diverter face plate 193 is preferably a flat plate constructed of a nonporous material, such as steel. Projecting perpendicularly from the diverter face plate 193, the diverter side plates 194 extend the full length of the sides of the diverter face plate 193 and extend beyond the diverter face plate 193 at the top end 191.

The hinged connection 196 pivotally connects the top end 191 to the bucket 20. Each of the diverter side plates 194 attaches to a separate side wall 48 of the bucket 20 proximal the front 24. The diverter 190 protrudes beyond the front 24 exterior the bucket 20. The attachment of the diverter 190 to the side walls 48 is made intermediate the top and bottom of the bucket 20. From the top end 191, the diverter 190 extends downward at an acute angle to the bucket 20. In this way, the diverter 190, particularly the face plate 193, extends in front of the exit opening 60. To provide the desired deflection, the diverter face plate 193 has a sufficient surface area that flowable material exiting the exit opening 60 and projecting horizontally therefrom will strike the diverter face plate 193 and deflect downward. Stated another way, the projected area of the diverter face plate 193 on the exit opening 60 is equal to or greater than the cross sectional flow area of the exit opening 60 when open to its normal pour size.

Although the possible attachments of the diverter 190 to the bucket 20 are many, the preferred attachment utilizes a pair of diverter connector pins 201 and a matching pair of diverter connector slots 198. A diverter connector pin 201 extends horizontally from each side wall 48. The diverter connector pin 201 includes an enlarged head 202 at its end distal to the side wall 48. Accordingly, the diverter connector pin 201 narrows at its end proximal the side wall 48. The diverter side plates 194 include the diverter connector slots 198 therethrough. The diverter connector slots 198 have an enlarged portion 199 and a narrow portion 200. The cross sectional area of the enlarged portion 199 is sufficiently large to permit the enlarged head 202 to pass therethrough. Once the head 202 is through the enlarged portion 199, the diverter 190 is moved relative to the bucket 20 so that the diverter connector slot 198 is repositioned with the diverter connector pin 201 in the narrow portion 200. Because the narrow portion 200 has a smaller cross sectional area than the head 202, the head 202 cannot pass through the diverter connector slot narrow portion 200 and the diverter 190 is held on the diverter connector pins 201.

The diverter 190 may be free to rotate about the hinged connection 196, but preferably includes a diverter set means 210 that allows adjustment of the angle of the diverter 190 to the bucket 20. It allows selective and adjustable fixing of the diverter 190 in one of a plurality of predetermined positions. Preferably, the diverter set means 210 comprises diverter adjustment arms 220 that pivotally connect to the bucket 20 and include a plurality of diverter adjustment slots 224 therein that removably connect to diverter adjustment pin 212 on the diverter 190. Changing the pin to a different slot 224 changes the angle of the diverter 190 to the bucket 20. A diverter adjustment pin 212 extends substantially perpendicular from each diverter side plate 194. Like the diverter connector pins 201, the diverter adjustment pin 212 preferably has an enlarged head.

Adjustment arm connector means 222 removably and pivotally connects the diverter adjustment arm 220 to the bucket 20. The point of connection is below the connection of the diverter 190 to the bucket 20 and is spaced therefrom. Such connection may be a pin connection or any similar type that provides for the necessary pivoting of the diverter adjustment arm 220.

The diverter adjustment arm 220 is an elongated strip of relatively thin rigid material. The adjustment arm slots 224 are spaced along the length of the diverter adjustment arm 220. Typically, the slots 224 are open and are constructed to receive the diverter adjustment pin 212 therein. Accordingly, when the pin 212 is placed in one of the slots 224, the distance from the adjustment arm connection means 222 to the used diverter adjustment slot 224, the effective arm length, defines a predetermined angle of the diverter 190 to the bucket 20. Changing the diverter adjustment pin 212 to a different diverter adjustment slot 224 changes the effective arm length and, thus, changes the angle between the diverter 190 and the bucket 20.

As mentioned, the gate means 68 may alternatively be opened and closed manually as shown in FIGS. 22 through 27. The following discussion describes this manually controlled gate means 68. In this embodiment, a latching means 230 selectively holds the gate 70 in a closed position and releases the gate 70 to an open position. The latching means 230 may take any one of many possible embodiments. In a simple embodiment, the latching means 230 merely comprises a latch pin 231 extending from the side of the gate 70 and a latch 232 extending from the adjacent gate side wall. Alternatively, the latch 232 may be connected to the gate 70 and the latch pin 231 attached to the adjacent gate side wall.

The latch 232 includes a latch body having an attachment end and a latch end. The latch body includes an elongated latch arm 233 and a latch hook 234. At the latch end of the latch body, the latch hook 324 projects downward from the bottom of the latch arm 233. The latch hook 234 has at least two opposing faces, the catch face and the trip face. The latch hook 234 is constructed such that the catch face abuts the latch pin 231 and prevents the relative motion of the latch pin 231 and the latch 232 in a direction normal to the catch face when the latch 232 and latch pin 231 are in the latched position. However, the latch 232 may move in a direction parallel to the contact face.

The trip face of the latch hook 234 is angled relative to the contact face. When the trip face abuts the latch pin 231 and a force is applied therebetween, the force provides both a horizontal and vertical component that facilitates the relative movement between the latch 232 and the latch pin 231.

So that the latching means may be selectively latched and unlatched, either the latching pin 231 or the latch 232 or both must be able to move relative to the other. For example, as shown in FIG. 22, the latch is rotatably connected at its back. In this embodiment, the latch 232 rotates to facilitate selective latching of the latching means. Another possible embodiment is to include a latching pin 231 that may slide in a slot, but is biased toward the latching position. In this second embodiment, the pin may be forced from the latching position to release the latching mechanism. As shown in FIG. 22, the complete latch 232 may move to accommodate selective latching. In yet another embodiment, the latch hook 234 may be resilient to allow the latching pin 231 to pass thereby with sufficient force applied or may selectively retract into an upper open portion in the latch arm 233. Further, the latching mechanism may include more than one latch 232 for each latch pin 231 or more than one latch pin 231 for each latch 232. Using a latching mechanism on each side of the door provides more uniform latching. An alternative embodiment is to include more than two latching mechanisms or to position the latching mechanism at the bottom of the door.

Release means 250 provides for the manual release of the latching means 230. Like the latching means 230, the release means 250 may take a number of different forms. For example, in the simple latching mechanism shown in FIG. 23, the release means 250 is simply a pin handle 235 that projects from the side of the latch 232. A user merely lifts the latch 232 using the pin handle 235 to release the latching means 230. Because the bucket 20 contains a flowable material that exerts a pressure against the gate 70, when the latching means 230 is released the gate 70 is forced open. Preferably, the user does not lift the pin handle 235 (or trip the release means 250) using their hand, but instead uses a rigid, elongated device such as a shovel, to lift the latch 232. In this way, the user is removed from the front of the loader vehicle 110 and from the bucket 20, thereby, increasing the safety of the device 10.

Another embodiment for the release means 250 is shown in FIGS. 22. In this embodiment, the bucket 20 includes two latching means 230, one on each side of the bucket 20. The release means 250 includes a release trigger 251 fixedly attached to a shaft 252. Therefore, when the release trigger 251 is pressed from a resting position to a release position, the shaft 252 rotates in the bearings 253. The release trigger 251 extends in front of the bucket 20 to provide ready access. A linkage 254 fixedly attached to the shaft 252 extends in a rearward direction toward the back of the bucket 20. A spring 256 connected to the end of the linkage 254 distal the shaft 252 biases the release trigger 251 and the latching means 230 to the resting position. A pin 255 rotatably connects a rod 257 to the linkage 254 at a position intermediate the ends of the linkage 254. The rod 257 hangs down from the linkage 254. At least one support 258 maintains the lateral position of the rod 257. The support 258 need only define a rearward motion limit and a downward motion limit beyond which the rod 257 cannot move. Because the linkage 254 moves in an arc whereas the rod 257 moves vertically, the pin connection between the rod 257 and the linkage 254 may be slotted. In this embodiment, the latch 232 is fixedly attached to the rod 257 and, therefore, moves with the rod 257. A hinged connection 259 connects the gate 70 to the bucket 20. Consequently, a user need only press or strike the release trigger 251 to release the latching means 230.

Another possible embodiment for the latching means 230 includes a latch 232 and a matching latch receiver 236 (see FIGS. 24 through 27). Essentially, the latch receiver 236 is a hole or upper open portion constructed to selectively receive the latch 232 therein.

Figure 24:
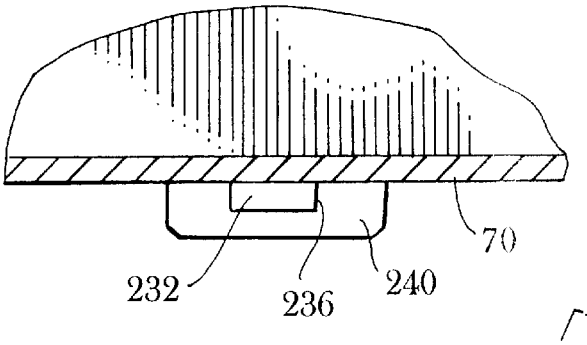
FIG. 24 is a partial, front elevational view of the dispensing bucket apparatus having a manual release.
Figure 25:
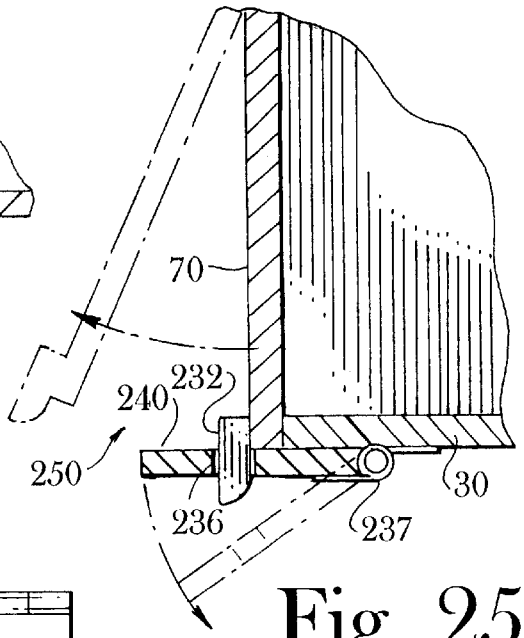
FIG. 25 is a partial, side elevational view of the dispensing bucket apparatus having a manual release.

The latching means 230 and release means 250 shown in FIGS. 24 and 25 disclose a device that uses a single latching means 230 positioned in the center of the gate 70 at its bottom end. In this embodiment, the latching means 230 comprises a latch 232 integrally connected to the gate 70 and a receiving hole extending through the release trigger 251.

A biasing spring 257 biases the release trigger 251 to the resting position wherein the release trigger 251 is substantially perpendicular to the gate 70. When the release trigger 251 is forced downward, the latch 232 is freed from the latch receiver 236 and the pressure from the flowable material in the bucket 20 forces the gate 70 open.

Figure 26:
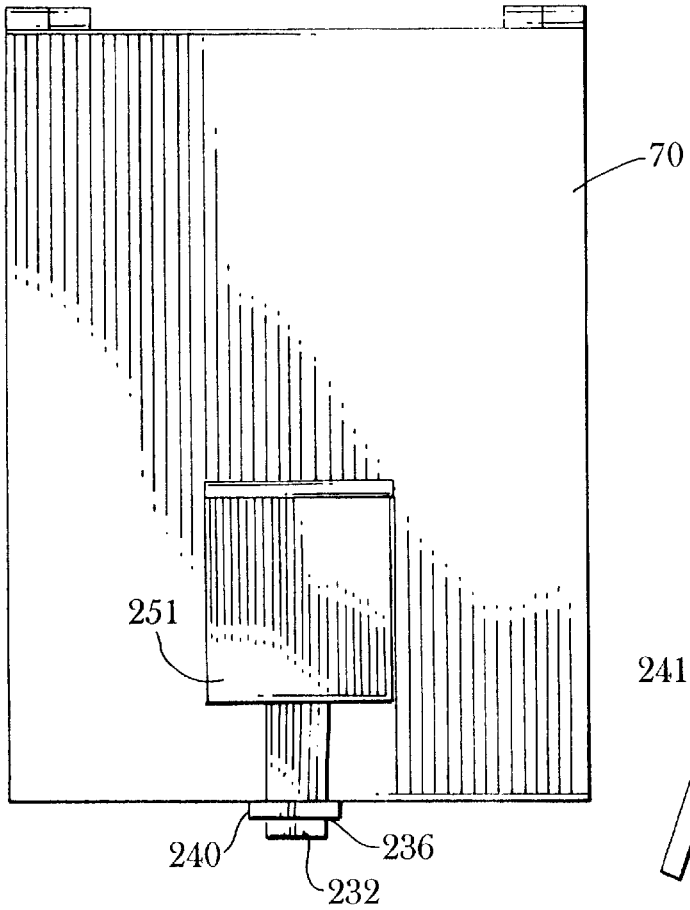
FIG. 26 is a partial, front elevational view of the dispensing bucket apparatus having a manual release.
Figure 27:
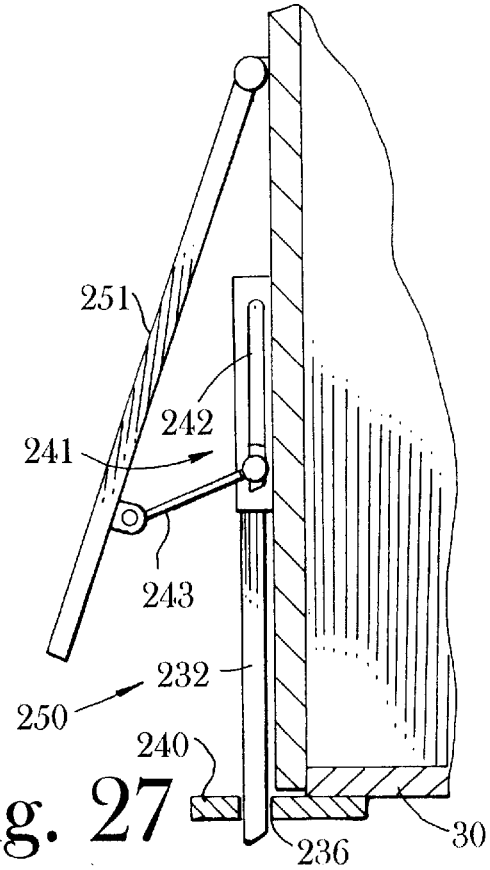
FIG. 27 is a partial, side elevational view of the dispensing bucket apparatus having a manual release.

Likewise, the latching means 230 and release means 250 shown in FIGS. 26 and 27 disclose a device that uses a single latching means 230 positioned in the center of the gate 70 at its bottom end. In this embodiment, the latch 232 is slidably mounted to the gate 70. The latch receiver 236 extends through a separate bracket 240 that is fixedly attached to the bottom of the bucket 20 and projects forward. In the latched position, the latch 232 extends through the latch receiver 236. The upper end of the latch 232 includes sliding attachment means 241 that provides slidable attachment between the latch 232 and a bracket 242 fixedly attached to the gate 70. The release trigger 251 is rotatably connected to the gate above the bracket 242. A linkage 243 pivotally connected to both the release trigger 251 and the latch 232 translates the movement of the release trigger 251 into vertical motion of the latch 232. Because the connection of the linkage 243 to the release trigger 251 is lower than the connection of the linkage 243 to the latch 232, the inward movement of the release trigger 251 forces the latch 232 up. Likewise, the weight of the latch 232 biases the release trigger 251 to the resting position. When the latching means 230 is in the latched position and the release trigger 251 is pressed toward the gate 70, the flowable material in the bucket 20 forces the gate 70 open.

Once released and after the pour is complete, the gate 70 must again be latched to seal the bucket 20 for refilling. Due to the angled trip face, the user need only press the gate 70 toward the bucket to engage the latching means 230 and latch the gate 70.

Although the previous embodiments describe manual release means 250, the manual trigger may be replaced with an electronic trigger or a hydraulic release. With these alternate release means 250, the driver of the loader vehicle 110 could release the latching means 230 from within the cab of the loader vehicle. However, closing the gate still requires the application of an external force to the gate 70 to return the latching means 230 to the latched position.

Regardless of the manner in which the gate means 68 is opened and controlled, the bucket includes a unique feature by virtue of its shape. This unique feature is that the operator sitting within the loader vehicle 110 can see inside the bucket 20 when the bucket 20 is in a lowered position and can view the pour when the bucket 20 is in the pouring position. Thus, the operator is able to see inside the bucket 20 during filling and transport and is able to view the pour.

When the apparatus 10 is first connected to the loader vehicle 110, the bucket 20 is empty and the gate 70 is positioned in its closed position. The bucket 20 is generally in a lowered position relatively near the ground, but raised slightly therefrom. In this position, the bucket 20 is more easily filled with flowable material. Once the bucket 20 is filled, the operator drives the loader vehicle 110 to the pour site typically raising the bucket 20 only enough to avoid collision with the terrain. Each of these positions is generally referred to herein as the lowered position.

In this lowered position, the operator can see into the bucket because the peripheral wall 40 is sufficiently low, or short, that a user sitting in the loader vehicle 110 can look over the top of the peripheral wall 40 into the bucket 20. When the bucket 20 is empty, the peripheral wall 40 is short enough that an operator can look over the wall 40 and see the bottom of the gate 70. This allows the operator to watch the bucket being filled and gage the amount of flowable material being placed in the bucket 20. The operator's ability to see into the bucket 20 during filling is important to ensure that the bucket 20 is not overfilled. Overfilling may cause spillage or more critical harm such as damage to the loader vehicle 110 caused by exceeding the load capacity of the loader vehicle 110. Additionally, this design allows the operator to view the load during transport and adjust the loader vehicle 110 speed and route as needed to avoid spillage. Watching the flowable material permits the user to avoid extreme sloshing that may result in spillage.

When full, the flowable material level within the bucket 20 is relatively high. Also, as mentioned previously, the gate 70 opens from the bottom. Therefore when the gate 70 opens, the pressure of the flowable material forces the flowable material through the exit opening 60 without any—very little—tilting of the bucket 20. As the flowable material exits the bucket 20 and the level of material drops, the flow rate through the exit opening 60 decreases. Thus, the operator will typically raise the bucket 20 and will tilt the front 24 downward. Gravity will then force the flowable material toward and through the exit opening 60. The operator may shake the bucket 20 by rapidly jogging the loader vehicle 110 controls to further enhance the movement of the flowable material from the bucket 20. The funnel design of the bucket 20 directs the flowable material to the exit opening 60. When the bucket 20 is tilted and in the process and position of pouring, it is said herein generally to be in the pouring position.

Preferably, the bottom 30 of the bucket is substantially flat, particularly its lower surface 34. This flat bottom 30 combined with the exit opening 60 that extends to the bottom 30 of the bucket 20 allows the operator to look along the bottom 30 and see the flowable material exiting the bucket 20 when the bucket is in the pouring position. This aspect of the invention is important because it facilitates accurate pours and reduces spillage. FIG. 3 illustrates the importance of accurate pouring. In that figure, the bucket 20 is being used to fill a tubular mold 270 with concrete. The mold 270 has a relatively small opening and the operator's ability to view the pour is vital to avoid waste. Although the figure shows the bucket in a raised position, the bucket 20 construction would allow the operator to view the pour equally well if the pour was being made near the ground, such as in a post hole. When lowered, the operator can also look into the bucket 20 over the peripheral wall 40 and watch the flowable material exit the bucket 20 from the inside. This allows the operator to view the pour before the bucket 20 is tilted. Further, the exit opening 60 and gate 70 are positioned in the front 24 of the bucket 20 in the natural direct line of sight of the operator of the loader vehicle 110 enhancing the operator's ability to oversee the pour.

Once substantially emptied, the operator returns the bucket 20 to its lowered position, closes the gate 70, and returns to obtain another load of flowable material. The process is then repeated.

It is this process of filling the bucket 20, transporting the flowable material to the desired pour site, and pouring the flowable material that comprise the essential elements of the methods associated with the present invention. A detailed description of these methods follows.

One aspect of the invention is a method of delivering a flowable material. The steps involved in the method include attaching the previously described dispensing bucket apparatus 10 to a loader vehicle 110 and placing the flowable material within the bucket 20. The next step involves driving the loader vehicle 110 to the desired delivery site and positioning the exit opening 60 at the desired delivery site. Controlling the gate means 68 of the bucket 20 from within the loader vehicle 110 to regulate and control the flow and flow rate of flowable material from the bucket 20 completes the dispensing method.

A related method is a method of forming concrete structures. In this method, a mold 270 having a pour opening 272 is formed and acts as the pour site of the previously described method. The bucket 20 is attached to the loader vehicle 110; the flowable material is placed within the bucket 20; the loader vehicle 110 is driven to the desired delivery site and the exit opening 60 is positioned over the pour opening 272; and the gate means 68 is controlled from within the loader vehicle 110 to regulate and control the flow and flow rate of flowable material from the bucket 20 into the mold 270. After the concrete has set, the mold 270 is removed from around the concrete structure. Accordingly, the method comprises the steps of forming a mold 270 having a pour opening 272 for the concrete structure, attaching to a loader vehicle 110 a bucket 20, placing the concrete in the bucket 20, driving the loader vehicle 110 to the desired delivery site and positioning the exit opening 60 over the pour opening of the mold 270, controlling the gate means 68 from within the loader vehicle 110 to control the flow and flow rate of the flowable material from the bucket into the mold 270, and removing the mold 270 from around the concrete structure after the concrete has set.

A final method associated with the invention is that of controlling the flow of the flowable material from a bucket 20 that is attached to a loader vehicle 110. The steps involved in this method include selectively opening and sealingly closing the exit opening 60 and controlling the size of the exit opening 60 when the exit opening is open using a gate 70 and actuating the gate 70 and controlling the position of the gate 70—and, thus, the size of the exit opening 60—from within a loader vehicle 110 when the bucket 20 is functionally attached to the loader vehicle 110 using a hydraulic cylinder 120 attached to the gate 70 and actuated by a hydraulic power system 118 of the loader vehicle 110.

While the apparatuses and methods described herein are the preferred embodiments of the invention, the invention is not limited to these precise forms and changes may be made to the invention without departing from its scope.

I claim:

1. A dispensing bucket apparatus comprising:

a bucket having an upper open portion adapted to receive a flowable material therein;

a bottom of the bucket opposite the upper open portion;

at least one side wall of the bucket sealingly and fixedly attached to and extending upwardly from the periphery of the bottom;

so that the bottom and the at least one side wall define the upper open portion, the upper open portion vertically spaced above the bottom;

the bottom and the at least one side wall formed from a non-porous material;

the bucket defining an exit opening through the at least one side wall that is sufficiently large to permit the flowable material to exit therethrough;

gate means for selectively opening and sealingly closing the exit opening and controlling the size of the exit opening when the exit opening is open;

the bucket is adapted to be removably affixed to a loader vehicle; and gate control means for actuating the gate means and controlling the position of the gate means—and, thus, the size of the exit opening—from within the loader vehicle when the bucket is functionally attached to the loader vehicle.

2. An apparatus as claimed in claim 1 wherein the gate control means comprises:

a hydraulic cylinder having a movable ram;

the hydraulic cylinder is attached to the bucket;

the movable ram is attached to the gate means;

the loader vehicle has a hydraulic power system;

the hydraulic cylinder is in flow communication with and is controlled by the hydraulic power system when the bucket is functionally attached to the loader vehicle;

so that a user in the loader vehicle controlling the hydraulic power system controls the hydraulic cylinder and the ram movement and, thus, the movement and position of the gate means.

3. An apparatus as claimed in claim 2 wherein the gate control means comprises:

a user controlled valve within the loader vehicle adapted and positioned for ready access and control by a user sitting within the loader vehicle;

the user controlled valve is in flow communication with both the hydraulic power system and the hydraulic cylinder when the bucket is functionally attached to the loader vehicle; and the user controlled valve is positioned and adapted for adjustable control of the flow of hydraulic fluid from the hydraulic power system to the hydraulic cylinder.

4. An apparatus as claimed in claim 1 wherein:

the exit opening extending to the bottom of the bucket; and the gate means selectively openable from the bottom;

so that the bucket is emptied proximal the bottom through the exit opening.

5. An apparatus as claimed in claim 1 wherein the gate means comprises:

a gate;

a pair of slots attached to the at least one side wall, one slot of the pair of slots positioned on each side of the exit opening;

the gate extending between and slidably positioned in the slots;

so that the gate slides in the slots to selectively open and sealingly close the exit opening and to control the size of the exit opening when the exit opening is open.

6. An apparatus as claimed in claim 1 wherein the gate means comprises:

a gate having a top end; and the top end of the gate is connected to the bucket by a hinged connection at the top end of the exit opening;

so that the gate rotates about the hinged connection to selectively open and sealingly close the exit opening and to control the size of the exit opening when the exit opening is open.

7. An apparatus as claimed in claim 1 wherein the gate control means comprises:

a plurality of hydraulic cylinders each having a movable ram;

the plurality of hydraulic cylinders are attached to the bucket;

the movable rams are attached to the gate means;

the loader vehicle has a hydraulic power system;

the plurality of hydraulic cylinders are in flow communication with and are controlled by the hydraulic power system when the bucket is functionally attached to the loader vehicle;

so that a user in the loader vehicle controlling the hydraulic power system controls the plurality of hydraulic cylinders and the ram movement and, thus, the movement and position of the gate means.

8. An apparatus as claimed in claim 1 further comprising means for deflecting the flowable material exiting through the exit opening in a downward direction.

9. A dispensing bucket apparatus comprising:

a bucket having an upper open portion adapted to receive a flowable material therein and an exit opening that is sufficiently large to permit the flowable material to exit therethrough;

gate means for selectively opening and sealingly closing the exit opening and controlling the size of the exit opening when the exit opening is open;

the bucket adapted for removable attachment to a loader vehicle;

gate control means for actuating the gate means and controlling the position of the gate means—and, thus, the size of the exit opening—from within the loader vehicle when the bucket is functionally attached to the loader vehicle;

a hydraulic cylinder having a movable ram;

the hydraulic cylinder is attached to the bucket;

the movable ram is attached to the gate means;

the loader vehicle has a hydraulic power system;

the hydraulic cylinder is in flow communication with and is controlled by the hydraulic power system when the bucket is functionally attached to the loader vehicle;

so that a user in the loader vehicle controlling the hydraulic power system controls the hydraulic cylinder and the ram movement and, thus, the movement and position of the gate means;

a connecting linkage having a first end and a distal second end;

the connecting linkage is constructed of a substantially rigid material;

the ram has an apogee end;

the first end of the connecting linkage is rotatably connected to the apogee end of the ram;

a stationary linkage support is fixedly attached to the bucket;

the connecting linkage is rotatably attached to the stationary linkage support intermediate the first end and the second end of the connecting linkage;

a gate linkage having opposing ends;

the gate linkage is constructed of a substantially rigid material;

the one end of the gate linkage is rotatably attached to the connecting linkage and the distal end of the connecting linkage is and rotatably attached to the gate means;

so that the connecting linkage and the gate linkage translate the movement of the ram into movement of the gate means.

10. A dispensing bucket apparatus comprising:

a bucket having an upper open portion adapted to receive a flowable material therein and an exit opening that is sufficiently large to permit the flowable material to exit therethrough;

gate means for selectively opening and sealingly closing the exit opening and controlling the size of the exit opening when the exit opening is open;

the bucket adapted for removable attachment to a loader vehicle;

gate control means for actuating the gate means and controlling the position of the gate means—and, thus, the size of the exit opening—from within the loader vehicle when the bucket is functionally attached to the loader vehicle;

means for deflecting the flowable material exiting through the exit opening in a downward direction comprising:

a diverter having a top end;

the top end of the diverter is connected to the bucket by a hinged connection so that the diverter rotates about the hinged connection and the top end;

the diverter extends at least the full width of the exit opening and at least the full height of the exit opening when the exit opening is fully opened; and the diverter is substantially rigid and nonporous.

11. An apparatus as claimed in claim 10 wherein the diverter is free to rotate about the hinged connection.

12. An apparatus as claimed in claim 10 further comprising diverter set means for selectively and adjustably fixing the diverter in one of a plurality of predetermined angular positions.

13. A dispensing bucket apparatus comprising:

a bucket having an upper open portion adapted to receive a flowable material therein and an exit opening that is sufficiently large to permit the flowable material to exit therethrough;

a substantially flat bottom of the bucket formed of a non-porous material;

a peripheral wall of the bucket sealably and fixedly attached to and extending upward from the periphery of the bottom, the peripheral wall defining the upper open portion at a top end of the peripheral wall;

so that the upper open portion is vertically spaced above the bottom of the bucket;

gate means for selectively opening and sealingly closing the exit opening and controlling the size of the exit opening when the exit opening is open;

the bucket adapted to be removably affixed to a loader vehicle;

the exit opening positioned in the peripheral wall and extending to the bottom of the bucket; and the gate means opening proximal the bottom;

so that the bucket is emptied proximal the bottom through the exit opening.

14. An apparatus as claimed in claim 13 further comprising:

when affixed to the loader vehicle, the bucket may be operably selectively positioned in a lowered position and a pouring position;

the lowered and pouring positions comprising all of the positions in which the bucket may be placed;

the bucket adapted to receive and hold a flowable material therein, to be filled, when in the lowered position;

the peripheral wall is sufficiently short that a user seated in the loader vehicle can see into the bucket while the user is sitting in the loader vehicle and when the bucket is in a lowered position;

the bucket adapted so that the user seated in the loader vehicle may look through the upper open portion and see the gate means when the bucket is in the lowered position regardless of the forward or rearward tilt of the bucket relative to the ground and the loader vehicle, the tilt of the bucket limited to facilitate filling with and transport of a flowable material when in the lowered position;

the bottom of the bucket is substantially flat so that the user can look along the bottom and see the flowable material exiting the bucket while the user is sitting in the loader vehicle and when the bucket is in the pouring position.

15. An apparatus as claimed in claim 14 further comprising:

the bucket having a front and a back;

the back of the bucket adapted to be removably affixed to a loader vehicle; and the exit opening provided through the front of the bucket.

16. A dispensing bucket apparatus comprising:

a bucket having an upper open portion adapted to receive a flowable material therein and an exit opening that is sufficiently large to permit the flowable material to exit therethrough;

the bucket having a back, and two side walls that extend upwardly from and are fixedly, sealably connected to the perimeter of a bottom to form a peripheral wall, the back sealably connected to the side walls;

the bottom, the back, and the two side walls formed of a non-porous material;

the side walls converge linearly toward one another from opposing ends of the back to the exit opening;

so that the bucket utilizes the pressure exerted by the flowable material against the side walls to force the flowable material through the exit opening;

gate means for selectively opening and sealingly closing the exit opening; and the bucket adapted to be removably affixed to a loader vehicle.

17. An apparatus as claimed in claim 16 wherein:

the angles formed between the back and each of the side walls are equal;

so that the exit opening is centrally positioned in the front of the bucket.

18. An apparatus as claimed in claim 16 further comprising:

gate control means for actuating the gate means and controlling the position of the gate means—and, thus, the size of the exit opening—from within the loader vehicle when the bucket is functionally attached to the loader vehicle.

19. An apparatus as claimed in claim 16 further comprising:

latching means for releasably maintaining the gate means in a closed position; and release means for releasing the latching means;

so that the gate means may be held in a closed position by the latching means during transport of the flowable material; and so that the gate means may be released to open and allow the flowable material to exit through the exit opening.

20. A dispensing bucket apparatus comprising:

a bucket having an upper open portion adapted to receive a flowable material therein and an exit opening that is sufficiently large to permit the flowable material to exit therethrough;

the bucket having a back, and two side walls that extend upwardly from the perimeter of a bottom to form a peripheral wall;

the side walls converge linearly toward one another from opposing ends of the back to the exit opening;

so that the bucket utilizes the pressure exerted by the flowable material against the side walls to force the flowable material through the exit opening;

gate means for selectively opening and sealingly closing the exit opening; and the bucket adapted to be removably affixed to a loader vehicle;

gate means for selectively opening and sealingly closing the exit opening; and the bucket adapted to be removably affixed to a loader vehicle;

latching means for releasably maintaining the gate means in a closed position; and release means for releasing the latching means;

so that the gate means may be held in a closed position by the latching means during transport of the flowable material;

so that the gate means may be released to open and allow the flowable material to exit through the exit opening;

the gate means comprising a gate attached to the bucket at the top end of the gate by a hinged connection; and so that, when the latching means is released by the release means, the pressure of the flowable material in the bucket forces the gate open allowing the flowable material to exit through the exit opening.

21. A method of delivering a flowable material comprising:

attaching a bucket to a loader vehicle, the bucket having a non-porous bottom and a non-porous peripheral wall sealably attached to and extending about the periphery of the bottom to define an upper open portion at the top of the peripheral wall opposite the bottom that is adapted to receive a flowable material therein, the peripheral wall defining an exit opening through the peripheral wall and positioned at the front of the bucket that is sufficiently large to permit the flowable material to exit therethrough, providing an adjustable gate means for selectively opening and sealingly closing the exit opening and controlling the size of the exit opening when the exit opening is open;

placing the flowable material in the bucket;

driving the loader vehicle to the desired delivery site and positioning the exit opening at the desired delivery site;

controlling the gate means from within the loader vehicle to control the flow and flow rate of the flowable material from the bucket; and pouring the flowable material through the peripheral wall via the exit opening from the front of the bucket.

22. The method as claim in claim 21, further comprising looking through the upper open portion while sitting in the loader vehicle to gage the fill level during placement of the flowable material in the bucket.

23. The method as claim in claim 21, further comprising gaging the flow rate of flowable material from the bucket while seated in the loader vehicle by looking along the bottom of the bucket, the bottom having a substantially flat lower surface.

* * * * *